United States Patent [19]

Blessing

[11] 4,109,596

[45] Aug. 29, 1978

[54] AUTOMATIC STITCHING PATTERN CONTROL SYSTEM FOR A SEWING MACHINE

[75] Inventor: Hubert Blessing, Dallas, Tex.

[73] Assignee: Levi Strauss & Co., San Francisco, Calif.

[21] Appl. No.: 809,305

[22] Filed: Jun. 23, 1977

[51] Int. Cl.[2] ..... D05B 19/00

[52] U.S. Cl. ..... 112/121.11; 112/205

[58] Field of Search ..... 112/121.11, 121.12, 112/121.15, 204, 205, 102, 153

[56] References Cited

U.S. PATENT DOCUMENTS

| | | | |
|---|---|---|---|
| 2,906,217 | 9/1959 | Myska | 112/121.11 X |
| 3,385,244 | 5/1968 | Ramsey et al. | 112/121.11 |
| 3,459,144 | 8/1969 | Ramsey et al. | 112/121.11 |
| 3,459,145 | 8/1969 | Ramsey et al. | 112/121.11 |
| 3,650,229 | 3/1972 | Rovin | 112/121.11 |
| 3,693,561 | 9/1972 | Hrinko et al. | 112/121.11 |
| 3,830,175 | 8/1974 | Levor | 112/121.12 |
| 3,896,749 | 7/1975 | Brauns et al. | 112/121.12 |
| 4,019,447 | 4/1977 | Blessing et al. | 112/121.11 |

*Primary Examiner*—H. Hampton Hunter

*Attorney, Agent, or Firm*—Limbach, Limbach & Sutton

[57] ABSTRACT

A servo-system is utilized to control the orientation of a fabric work piece being sewn by mechanically following the fabric work piece orientation, connecting a detector to move in response to a change in the fabric work piece orientation, moving a pattern representing a desired stitching pattern past the detector in synchronism with the rate of feed of the fabric work piece through the sewing machine and reorienting the fabric work piece in a manner to cause the detector to accurately follow the pattern of the desired stitching.

8 Claims, 4 Drawing Figures

AUTOMATIC STITCHING PATTERN CONTROL SYSTEM FOR A SEWING MACHINE

BACKGROUND OF THE INVENTION

This invention relates generally to an improved control mechanism for feeding limp sheet material, and particularly for such a system that guides fabric movement through a sewing machine.

Present clothing products often employ as an integral part of the design thereof extra stitching patterns for aesthetics or to form a trademark. One example of such trademark stitching is an arcuate back pocket stitching pattern that identifies the manufacturer of a leading brand of denim pants. In these and other controlled stitching applications, it is highly desirable that each item of clothing be made with substantially the same pattern and yet retain the appearance of being stitched under the control of a human operator. However, uniformity of stitching in a large volume clothing producing operation is difficult to maintain when the quality of the stitching is dependent upon the individual sewing machine operator's skill.

It has heretofore been proposed to use servo mechanisms, in some cases of the x-y type, to position the fabric work piece in correspondence with a pattern which is mechanically or electro-mechanically followed in synchronism with the sewing operation. See for example U.S. Pat. Nos. 3,385,244 — Ramsey and 3,896,749 — Brauns, et al.

These devices all suffer the disadvantage that their relatively large mass produces inertial forces which make for inaccurate stitching as well as greatly limiting the speed of the sewing operation. This is particularly true where stepper motors, or D.C. motors driven intermittently, are used to move the fabric work piece. Such motors simply cannot keep pace with a high speed sewing operation when they are required to move a fabric work piece fastened in a frame.

To overcome this problem, to some extent, other prior art devices have used guide wheels operated by servo motors which turn against the fabric work piece and guide it by pivoting it around the sewing needle during the interval when the needle is in the down position. See, for example, U.S. Pat. Nos. 3,459,145 — Ramsey or 3,693,561 — Hrinko, et al. Both of these devices use either stepper motors, or intermittently driven D.C. motors, and neither has a feedback, servo-system to follow an external pattern. Moreover both devices are greatly speed limited because of the high inertial forces needed to overcome their relative large masses.

In some of the above devices and in still other fabric feed guiding devices the guide mechanism is reciprocated up and down synchronously with the needle. See, for example, U.S. Pat. Nos. 3,650,229 — Rovin and 3,693,561 — Hrinko, et al. Such devices also are inherently speed limiting due to their need to overcome the inertia of their mass.

Therefore, it is a principal object of the present invention to provide a high speed automatic stitching pattern control system that can be operated with uniform results, even with the most complicated stitching pattern, by low skilled sewing machine operators.

It is another object of the present invention to provide an automatic stitching pattern control system capable of guiding cloth in a manner to stitch continuous curves.

It is yet another object of this invention to provide a mechanism for such automatic control that may be easily added to existing sewing machines.

It is a further object of the present invention to provide an economical and simple automatic stitching pattern control system wherein a controlling pattern may easily be generated and duplicated.

It is still another object of the present invention to provide an automatic stitching pattern control system that is easily integrated into a continuous process clothing manufacuturing operation.

SUMMARY OF THE INVENTION

These and additional objects are accomplished by the various aspects of the present invention wherein, briefly, the orientation of material being advanced by the sewing machine past a stitching needle is mechanically sensed by contact with the material and this position orientation is compared with a desired stitching pattern. When a comparison of the actual material orientation and the desired orientation from the stitching pattern shows a discrepancy, the material is automatically reoriented in a manner to bring the actual and desired orientation into coincidence. The preferred form of the material orientation sensor is a wheel held to contact the material on one side thereof and the preferred form of fabric orientation changing means is a motor driven wheel on an opposite side of the fabric held to urge the fabric down against the sensing wheel. The preferred form of pattern is an optical pattern held on a drum that is rotated by the same motor source that drives the sewing machine needle and material advancing mechanisms.

An advantage of this technique is that the stitching pattern that results is not dependent upon the particular skill of the sewing machine operator so long as the material and desired stitching pattern are properly positioned in the machine. The use of an optical pattern has an advantage of being easily constructed by exposing a photo-sensitive material to a pattern derived from actually hand sewing the desired stitching pattern one time by a highly skilled operator. Such a pattern can then be duplicated by standard economical xerography and photographic techniques for use on a number of machines at one time. And no additional mechanism is required to move the fabric through the sewing machine.

Material guiding is accomplished, in a preferred form, by rotating the material either when the needle is down or when the presser foot is lightly in contact with the fabric. When the needle is down the fabric pivots about the needle. When the needle is up the fabric both pivots and slides, to some extent. The amount of side slip, however, is barely detectable in the finished stitch and is at least as acceptable in appearance as a stitch produced by a human operator. This has an advantage that continuous curve stitching may be accomplished. This has the further advantage that no additional fabric holding frame is required, as is required in existing x-y fabric control systems, thus permitting the present invention to be utilized in a continuous process clothing manufacturing line. Moreover the driving wheel which is in contact with the fabric can therefore be operated by an analog motor, rather than a stepper motor, for high stitching speeds.

Additional objects, advantages and features of the various aspects of the present invention will become apparent from the following description of its preferred embodiment which should be taken in conjunction with the accompanying drawings.

DESCRIPTION OF A PREFERRED EMBODIMENT

Figure 1:
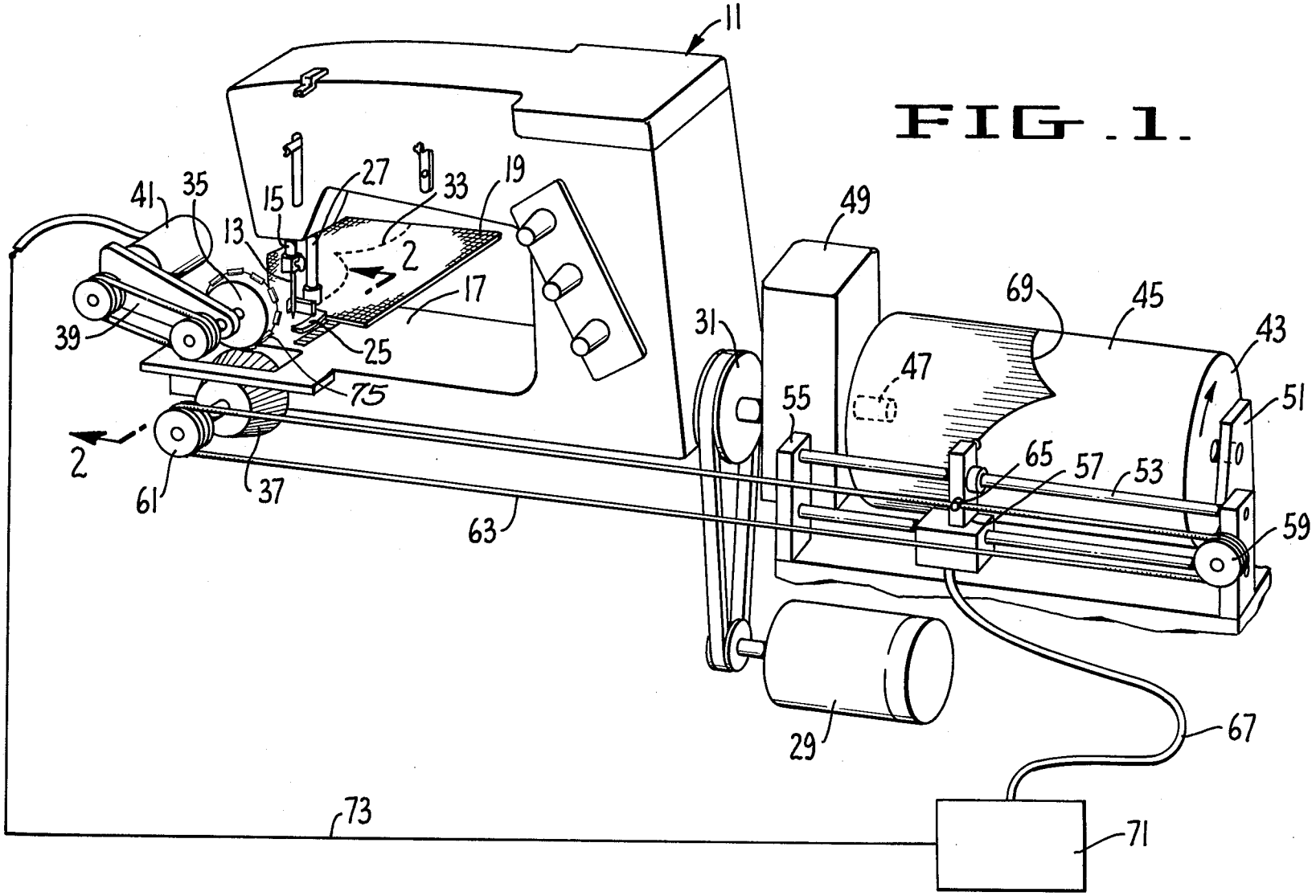
FIG. 1 shows a standard sewing machine having the control mechanism of the present invention added thereto.
Figure 2:
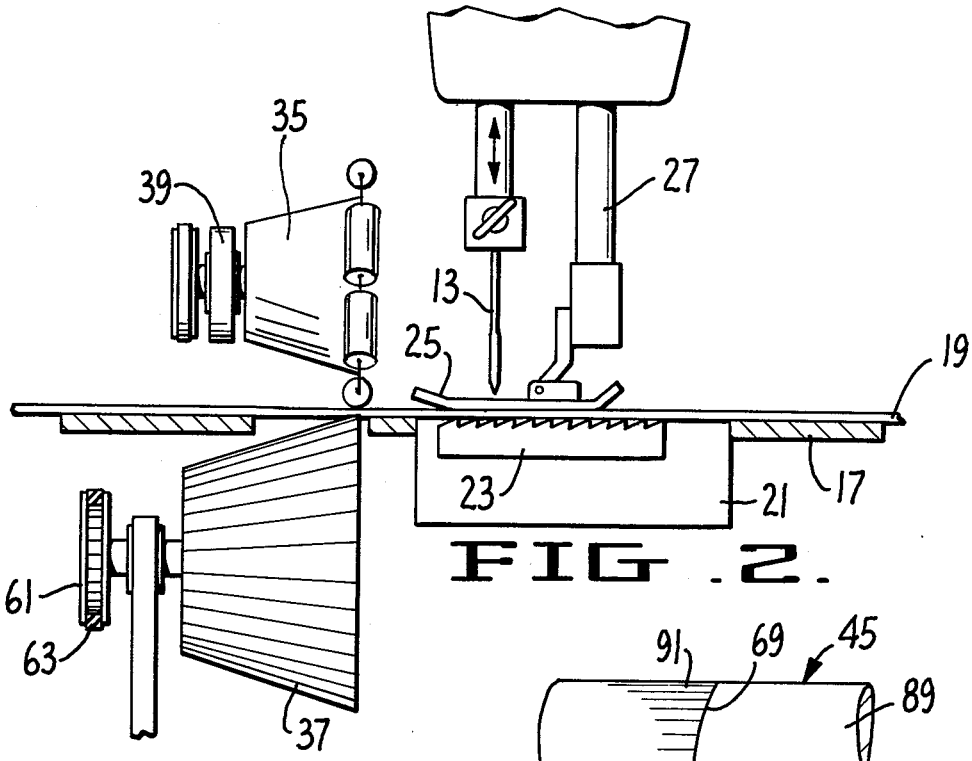
FIG. 2 is a view of the system of FIG. 1 at section 2—2 thereof.

Referring to FIGS. 1 and 2, a conventional sewing machine 11 is provided with a needle 13 that is reciprocated back and forth in a vertical direction by means of a needle support rod 15. A working surface 17 is provided over which material 19 to be sewn is passed. An opening 21 is provided in the working surface 17 into which the needle 13 is positioned at the bottom of its vertical reciprocal stroke after passing through the material 19. A conventional fabric feed dog system, including the feed dog 23, is provided as part of the sewing machine 11 for advancing the fabric 19 in synchronism with the stitching cycle of the needle 13. A presser foot 25 is rigidly attached to the sewing machine frame through a reciprocating support rod 27 and serves the conventional purpose of holding the fabric 19 down as it is sewn and fed.

The fabric feeding system including the feed dog 23 and the reciprocal stitching needle 13 and presser foot 25 are driven synchronously from a common motor 29. The electric motor 29 is operably connected through normal belt and pulley elements to a pulley 31 that is the input power to the sewing machine. Within the sewing machine 11 are the necessary conventional mechanical conversion elements (not shown) to convert the rotary motion of the input pulley 31 into the synchronous reciprocal motion of the needle 13 and operation of the fabric feeding mechanism such as the feed dog 23 and presser foot 25.

What has been described is nothing more than an ordinary electrically driven sewing machine. An operator usually guides the material 19 as to its angular orientation with respect to the needle 13 as the sewing machine automatically moves it in the direction shown. Such rotation or alignment by the operator causes the stitches to be placed on the fabric 19 in a desired pattern, such as the stitches 33 shown in FIG. 1. However, the present invention contemplates an addition to the ordinary sewing machine 11 which will automatically guide and orient the material 19 as it is mechanically advanced at high speed through the sewing machine 11.

Fabric orientation is made possible principally by a driving or guide wheel 35 whose outer circumference presses the fabric 19 against a fabric position sensing wheel 37. The position sensing wheel 37 is held to rotate about an axis that is attached to the sewing machine frame. The driving wheel 35 is attached to rotate about an axis held by an appropriate support arm 39, which is also fixed (not shown) to the sewing machine cabinet, in close proximity to the presser foot 25. An electrical servo motor 41 has an output that is connected by a belt or chain to rotate the fabric drive wheel 35, in a conventional manner. Thus, when the electrical motor 41 is properly energized, the wheel 35 turns either clockwise or counter-clockwise, depending on the polarity or, with a synchronous A.C. motor, on the phase of the driving signal, and causes, because the fabric is pressed against the wheel 37, the fabric to be reoriented and the position sensing wheel 37 to be correspondingly rotated. The wheel 37 is serrated in order to grip the fabric in a direction of its rotation but at the same time to permit the fabric to be easily advanced through the sewing machine by the feed dog 23.

This mechanism, therefore, is capable of guiding the fabric 19 through the sewing machine, just as the hands of a seamstress so guide material in order that the stitching follows the desired pattern. The motor 41 may operate not only when the needle 13 is depressed through the fabric 19 so that the fabric is rotated about the needle but also when the needle is out of the fabric. This is made possible by the extremely high sewing rate of the sewing machine so that the duty cycle of the inserted needle is large compared to the speed of rotation of the guide wheel 35. Even so, a certain amount of side slip of the fabric does take place when the guide wheel 35 is turning and the needle is withdrawn out of the fabric. This side slip does produce a very slight zig-zag in the stitch but since the stitch length is short due to the high sewing rate, the zig-zag is acceptable in appearance, and is at least as good as the stitch of a hand operator. This provides continuous stitching rather than discontinuous stitching patterns. The axes of rotation of the drive wheel 35 and the position sensing wheel 37 are aligned substantially with the direction of travel of the fabric 19, at least as projected into a plane of the working surface 17. Therefore, movement of the wheel 35 causes the fabric to be moved in a direction substantially orthogonal to the direction of travel that the sewing machine 11 is giving the fabric.

In order to control the motor 41 to properly guide the material 19 according to a desired stitching pattern, a cylindrical drum 43 is adapted to have attached to its outside cylindrical surface an optical stitching pattern 45. The drum 43 is driven by rotation of its supporting shaft 47 through a gear reduction box 49 from the sewing machine input power pulley 31. In the schematic illustration of FIG. 1, an end of the shaft 47 is shown to be journaled in a support plate 51. A detector guide rod 53 is also connected at one end to the support plate 51 and at another end to a fixed support plate 55. The rod 53 is held parallel with the axis of rotation of the drum 43 and is adapted to have slid back and forth therealong over the entire length of the drum 45 and detector assembly 57.

The fixed support plate 51 also has a gear or pulley 59 attached thereto in a manner to be freely rotatable. A cooperating gear or pulley 61 is provided on the fabric position sensing wheel 37. A belt or chain 63 is connected between the elements 59 and 61 so that rotation of the wheel 37 in response to movement of the fabric 19 by the wheel 35 will cause the chain or belt 63 to move back and forth. The chain or belt 63 is attached at a point 65 to the detector 57 so that such rotation of the sensing wheel 37 causes the detector 57 to correspondingly move back and forth along its supporting and guiding rod 53.

The detector 57 is characterized by developing in an output electrical circuit 67, a signal that carries the information as to whether the detector is aligned with a desired stitching pattern 69 of the optical pattern 45.

This information is utilized by appropriate electronic circuits 71 to drive through conductors 73 the motor 41 to make any adjustments in the material 19 position that are required in order to maintain the detector 57 aligned with the desired pattern stitching line 69. Adjustments in the orientation of the fabric 19 are made when the detector 57 is not so aligned with the desired stitch line 69. The electronic circuitry 71 receives the detector output in the conductors 67 and applies an appropriate continuous signal in the line 73 to drive the motor 41 in an appropriate direction to cause, through the position sensing wheel 37, the detector 57 to again become properly aligned with the pattern 45. Thus, we have a closed loop servo-system which includes, as part of the loop, the cloth being stitched.

The motor 41 is driven in analog fashion, i.e., it does not turn with a fixed rate of speed which is synchronized with the sewing machine but instead the motor is turned at a speed proportional to the magnitude of the driving signal. This has the great advantage that the rate of sewing is not directly linked to the response speed of the motor 41. In stepper motor operated prior art guide mechanisms the inherent inertia of the motor limited not only the speed of response of the guide mechanism but also the sewing rate. This is because the guide motor and sewing machine were operated synchronously, i.e., the motor only turned incrementally when the needle was down to pivot the fabric about the needle.

The closed loop servo-system of the present invention is thus an "analog" system rather than a "digital" system. The guide wheel 35 can be turned through any distance necessary to reorient the detector assembly 57 over the pattern line 69. It is not forced to turn through some minimal incremental distance as was required in prior art stepper motor embodiments.

The driving wheel 35 contains a plurality of rollers, such as the roller 75, around its circumference. These rollers are held to be rotatable about axes which are tangentially held by the circular driving wheel 35. These rollers then permit the fabric 19 to be moved by the sewing machine 11 in the direction shown in FIG. 1. A mechanism is provided to lift the wheel 35, preferably by lifting its support frame 39, from contact with the fabric 19 at the beginning and end of the sewing operation.

Figure 3:
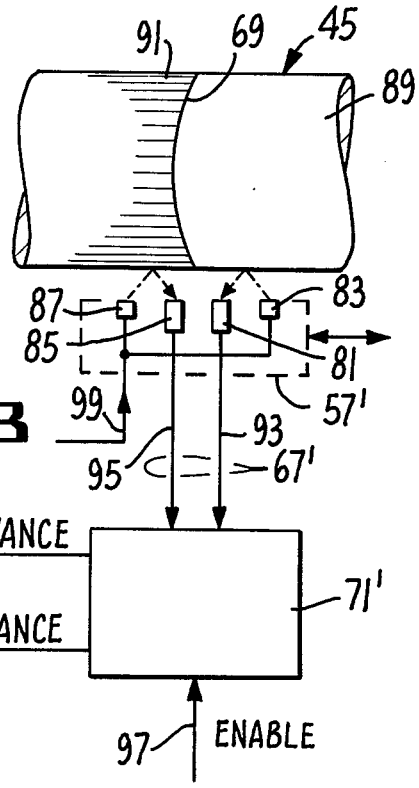
FIG. 3 shows in more detail a certain portion of the system of FIG. 1.

Referring to FIG. 3, a preferred specific form of the detector 57 of FIG. 1 is illustrated in conjunction with a preferred form of the electronics 71. Elements of FIG. 3 corresponding to those of FIG. 1 but which may be of a different form are denoted by the same reference numbers with a prime (') added. A first photo-sensitive element 81, such as a photo cell or a photo diode, is positioned to receive a reflection from the pattern 45 surface from a small beamed light source 83. A second photo-sensitive element 85 similarly receives a reflection from a point on the pattern surface 45 from its own light source 87. In the particular form of pattern 45 illustrated, one side 89 of the desired stitching pattern line 69 is made to be white while the other side 91 is made to be black. The result is that when the detector 57 is in its correct position with respect to the pattern line 69, an electrical signal output in a circuit 93 from the photo diode 81 will be high because it is observing a white surface while the output from the other circuit 95 from the photo-sensitive element 85 will be low because it is observing a dark surface. Electronics 71 then know that no signal need be sent in the circuit 73' to the servo motor 41.

However, when the pattern 45 advances and causes the line 69 to move with respect to the detector 57', both of the photo-sensitive elements 81 and 85 will receive the same signal, either black or white depending upon which direction the line 69 has moved. The electronic control 71', through conventional sensor bridge circuitry, then decodes which direction the motor 41 needs to be advanced by a signal of appropriate polarity or phase in the controlling line 73'. The motor 41 is so energized until the electronics 71' again sense that the photo-sensitive elements 81 and 85 are on opposite sides of the line 69, wherein the motor 41 is de-energized until the line 69 moves again relative to the detector 57'. The pattern illuminating lights 83 and 87 are energized by a common voltage source line 99. In actual practice the sensor-light source combinations are of a standard commercially manufactured type having the light source co-axial with the photo cell by means of a fiber optic light pipe which encases the photo cell.

Figure 4:
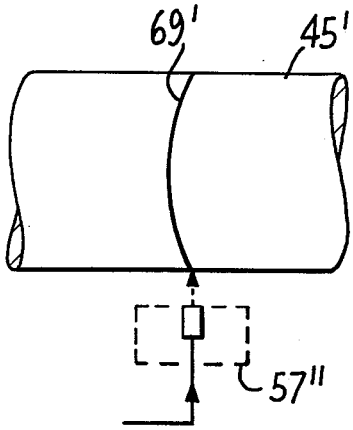
FIG. 4 illustrates a method of making a controlling pattern for use in the controlled sewing machine of FIGS. 1–3.

An advantage of the optical pattern control technique described is that a pattern 45' such as shown in FIG. 4 can easily be generated. The technique for generating the pattern is to include some photo-sensitive material 45' of FIG. 4 on the drum 43 of FIG. 1 and substitute for the detector 57 a narrow radiation source 57'' to which the photo-sensitive material is responsive. The motor 41 of FIG. 1 is disabled during this step. A piece of material is then stitched with the desired pattern by a highly skilled operator in order to obtain a master pattern 45'. As the orientation of the material is changed, the position of the light source 57'' will be changed because of its connection with the chain or belt 63. The resulting pattern is then darkened in on one side of the developed line 69' to form the controlling pattern 45. This controlling pattern can be easily duplicated by common photo copying techniques to run a number of sewing machines simultaneously.

The technique described can be utilized for a wide variety of stitching patterns. The example described above contemplates that the drum 43 will always be turned in synchronism with the sewing machine operation from a common motor source. Some stitching patterns may require that the sewing machine be stopped momentarily in order to give time for the material to be rotated a large angle about the needle before stitching is resumed. This is desired when the stitching pattern has an abrupt change in direction, an example being at the point of a shirt collar being stitched. To provide for such an application, a clutch can be inserted between the sewing machine 11 drive input and the drive pulley 31. The clutch is then controlled in an appropriate manner from the pattern 45, perhaps by a separate control signal and detector. When the clutch disconnects the sewing machine drive, the drum 43 continues to rotate and thus direction of the fabric 19 is still being controlled.

The preferred embodiment of the applicant's invention has been described above as utilizing an external pattern, advanced synchronously with the stitching rate, in cooperation with a feed guiding servo device which follows the pattern in a closed loop fashion through the fabric work piece. In less advantageous embodiments, however, the applicant's teachings can still be applied. For example, the pattern to be sewn can be printed directly on the fabric work piece and the photodetector assembly 57 can be mounted immediately adjacent to the presser foot 25, thereby eliminating the separate pattern drum 43 and sensor wheel 37, etc.

The pattern is designed in a distorted fashion to take into account the "parallax" effect of having the photo-detector spaced ahead of the needle 13. Because the guide wheel is ahead of the photo-detector and because at least part of the time the fabric work piece is pivoted about the needle by the guide wheel, the guide system has the disadvantage of being only a marginally stable, open loop servo-system. It still has the advantages that the guide wheel is mounted on an axle which does not reciprocate with the needle and the guide wheel motor operates in continuous fashion and not as a stepper motor. Both of these advantages are the key components of a high speed, automated sewing operation.

Furthermore, although the various aspects of the present invention have been described with respect to a preferred embodiment thereof, it will be understood that the invention is entitled to protection within the full scope of the appended claims. For example, if the photographic pattern controlling technique were undesirable for some reason, a magnetic or mechanical signal detecting and generating technique could be substituted.

I claim:

1. For a sewing machine of the type including:

a working surface adapted to carry fabric being sewn, means holding a sewing needle for reciprocation back and forth in repetitive stitching cycles through the fabric and through the working surface, means as part of the sewing machine for advancing fabric across the working surface in one direction, and a motor source connected to reciprocate the needle, an improved stitching pattern control system, comprising:

means positioned adjacent said working surface for controlling the orientation of the fabric with respect to the needle as the fabric is advanced over the working surface, thereby to change the direction of stitching being placed on the fabric, means provided adjacent said work surface for mechanically sensing by contact with the fabric any such change of direction, pattern means driven in synchronism with said needle from said motor source but independent of the fabric itself for setting the desired direction of stitching the fabric as a function of the fabric position with respect to the needle along said one direction, and means continuously receiving said desired fabric stitching direction setting and receiving an indication of the actual fabric stitching direction from said mechanical sensing means for automatically causing said fabric orientation controlling means to change the orientation of the fabric with respect to said needle as it is advanced in said one direction in a manner to equalize the desired and actual direction, whereby the stitching direction settings of the pattern means control the stitching pattern of the fabric.

2. The improved stitching pattern control system for a sewing machine according to claim 1 wherein said sensing means include a first wheel held to be on one side of the fabric with an axis of rotation fixed with respect to said working surface and oriented in a direction substantially the same as said fabric advancing means direction, and further wherein said fabric rotatable orientation means comprise on another side of the fabric a second wheel positioned to urge the fabric against said first wheel in a manner such that the rotation of the second wheel causes the fabric to move transversely with respect to the direction of fabric advance and the first wheel to rotate simultaneously, said fabric orientation controlling means including motor means operably connected to rotate said second wheel in a manner to cause the fabric stitching to follow the pattern.

3. The improved stitching pattern control system for a sewing machine according to claim 1 wherein said pattern means includes a revolving member, an optical pattern driven by engagement with the outside surface of the revolving member, the revolving member being rotated by connection with said common motor source, and further wherein said orientation changing means includes a photoelectric detector positioned to follow the optical pattern.

4. For a sewing machine of the type including:

a working surface adapted to carry fabric being sewn, means holding a sewing needle for reciprocation back and forth in repetitive stitching cycles through the fabric and through the working surface, means for advancing fabric across the working surface in one direction during the stitching cycle of the needle, and a common motor source connected to reciprocate the needle, an improved stitching pattern control system, comprising:

a sensing wheel held adjacent said working surface and against one side of the fabric and oriented to be rotated upon movement of the fabric in contact therewith in a direction non-parallel to the direction of advancement of the fabric through the sewing machine, a guide wheel positioned adjacent said working surface on another side of the fabric in a manner to urge the fabric against said sensing wheel, whereby rotation of said guide wheel causes said fabric to move in a direction non-parallel to the direction of the fabric's advancement through the sewing machine and to simultaneously rotate said sensing wheel, means including an electrical motor for driving said guide wheel, means for carrying a desired stitching pattern in sensor readable form, said means being driven by said sewing machine common motor source in a manner to move said pattern in one direction past a detecting station, a detector mounted at said detecting station in a manner to be slidable back and forth across said pattern in a direction substantially orthogonal to said one direction of travel of the pattern, said detector characterized by developing one signal when it is aligned with said stitching pattern and another signal when it is not aligned with the stitching pattern, means connecting said sensing wheel to said detector for unitary movement of the detector back and forth in response to rotation of the sensing wheel in either direction, and electrical means receiving the signal from the detector for causing said guide wheel driving means to move the guide wheel in a direction which, when coupled to the sensing wheel through the fabric, maintains said detector in a position with respect to the stitching pattern so that the detector emits said one signal, whereby said detector remains aligned with said pattern.

5. The improved stitching pattern control system for a sewing machine according to claim 4 wherein said pattern carrying means is a revolving member adapted to carry said pattern on its outside surface, said revolving member being driven in said one direction by rotation about its axis.

6. The improved stitching pattern control system for a sewing machine according to claim 4 wherein said pattern is optical and is adapted to be dark on one side of the desired stitching pattern line and light on the other side, said detectors being optical detectors and including a pair of detectors held adjacent but spaced apart along the direction that the detector slides back and forth, said electronic means sensing said one signal when the output of one detector detects a dark optical surface and the output of the other detector detects a light optical surface, said electronic means additionally characterized by causing said fabric moving wheel to be driven in one direction when both detectors detect a light surface and driven in another direction when both detectors detect a dark surface.

7. The improved stitching pattern control system for a sewing machine according to claim 4 wherein said guide wheel driving means rotate non-synchronously with the sewing needle reciprocation means.

8. An automated fabric guide device for a sewing machine of the type having a reciprocating sewing needle and a work surface for supporting the fabric as it is advanced under the reciprocating needle, the fabric guide device comprising a rotatable guide wheel fixedly mounted ahead of the needle with respect to the direction of fabric advancement through the sewing machine, the guide wheel bearing against one surface of the fabric and being rotatable about an axis which is non-parallel to the direction of fabric advancement, a detectable pattern having a stitch line thereon, detector means adjacent the stitch line pattern for monitoring a portion of the pattern and for producing a control signal representative of changes in the relative positions of the stitch line pattern and the detector means, servo motor means for rotating the guide wheel in response to the control signal, and means, including the guide wheel, for effecting controlled relative movement between the stitch line pattern and the detector means in synchronism with movement of the fabric relative to the work surface so as to maintain the detector means centered over the stitch line of the pattern.

* * * * *